US005924219A

United States Patent [19]

Healy et al.

[11] Patent Number: 5,924,219

[45] **Date of Patent: *Jul. 20, 1999**

[54] "WINDLASS" SHOE

[76] Inventors: Martin J. Healy, 4 Cardiff Rd.; Jeremy S. Johnson, 1029 Shawnee St., Apt. #L-9, both of Savannah, Ga. 31419

[ * ] Notice: This patent issued on a continued prosecution application filed under 37 CFR 1.53(d), and is subject to the twenty year patent term provisions of 35 U.S.C. 154(a)(2).

[21] Appl. No.: 08/881,921

[22] Filed: Jun. 25, 1997

Related U.S. Application Data

[63] Continuation-in-part of application No. 08/755,679, Nov. 25, 1996, abandoned.

[51] Int. Cl.[6] ..... A43B 5/00

[52] U.S. Cl. ..... 36/114; 36/88; 36/25 R

[58] Field of Search ..... 36/88, 89, 91, 36/92, 114, 170, 128, 25 R; 602/27, 28, 29, 65, 66

[56] References Cited

U.S. PATENT DOCUMENTS

| | | |
|---|---|---|
| Re. 23,922 | 1/1955 | Brown et al. . |
| 1,707,129 | 3/1929 | McMurchy . |
| 2,096,160 | 10/1937 | Chambers . |
| 2,158,153 | 5/1939 | Roberts . |
| 4,393,876 | 7/1983 | Dietrich . |
| 4,464,726 | 8/1984 | Westin et al. . |
| 4,476,639 | 10/1984 | Zaccaria . |
| 4,513,520 | 4/1985 | Koch . |
| 4,592,154 | 6/1986 | Oatman . |
| 4,941,273 | 7/1990 | Gross . |
| 4,972,613 | 11/1990 | Loveder . |
| 5,291,671 | 3/1994 | Caberlotto et al. . |
| 5,323,549 | 6/1994 | Segel et al. . |
| 5,445,603 | 8/1995 | Wilkerson . |

OTHER PUBLICATIONS

Basic Biomechanics of the Skeletal System. Frankel/Nordin 1980 pp. 193–220.

*Primary Examiner*—M. D. Patterson
*Attorney, Agent, or Firm*—Joel F. Spivak

[57] ABSTRACT

A shoe having a resilient strap running from under the forefoot to a rigid heal counter is provided. The shoe is constructed such that a fulcrum is provided under the strap so as to create a windlass effect during the normal walking cycle. This effect results in providing added support for the longitudinal medial arch of the wearer of the shoe.

12 Claims, 7 Drawing Sheets

"WINDLASS" SHOE

This application is a continuation-in-part of Ser. No. 08/755679, filed Nov. 25, 1996 now abandoned.

BACKGROUND—FIELD OF INVENTION

This invention relates to footwear having an addition to the exterior or interior thereof in the form of a "windlass strap" to help support the medial longitudinal arch and to such strap, per se.

BACKGROUND—DESCRIPTION OF PRIOR ART

The term "shoe" as used herein includes any kind of footwear including street shoes, sneakers and other athletic shoes, slippers and the like.

Most all shoes are constructed with an upper or vamp, an outsole and a midsole. The upper or vamp is made to keep the foot clean, dry, and protect it from other outside factors. The upper also keeps the foot from sliding off the outsole or midsole, which protects the foot from the discomfort of the ground. Also, uppers provide a cosmetic purpose, as shoes can be worn for dress, sport, or leisure.

U.S. Pat. No. 1,707,129 to McMurchy (1929) shows a horizontal vamp and upper used to provide medial/lateral support to the foot in a hockey boot. This material does not appear to run under the foot, nor act as a support to the medial arch.

U.S. Pat. No. 2,158,153 to Roberts and McKinnon (1939) describes an upper comprising a fore portion and a rear portion. These appear to be 2 distinct sections sewn together. Again, the material does not extend under the forefoot or appear to help support the medial longitudinal arch.

A diagram of a track shoe present in U.S. Pat. No. Re. 23,922 to Shapiro (1955) shows a strap which begins at the distal end of the forefoot and runs along the medial and lateral aspect of the foot and inserts into the heel counter. This strap or band functions to limit the amount of longitudinal stretch, and provide comfort to the foot. The band described does not run under the forefoot or ball of the foot, or run on a diagonal course along the medial arch and hence does not appear to offer any significant support to the medial longitudinal arch.

The bands or uppers described in the above patents suffer from a number of disadvantages:

a. None run underneath the ball: of the foot, and course on a diagonal plane to insert onto or in the vicinity of the heel counter. Therefore, none support the medial longitudinal arch.

b. No description of a windlass effect such as referred to at page 265, Chapter 13, Biomechanics of the Foot, in The foot and Lower Extremities, M. L. Root, is described. This windlass effect causes a tightening of the medial band as the forefoot is flexed.

c. No description of a fulcrum under the metatarsal heads is described. A fulcrum enables the windlass effect to occur.

d. No description of an adjustable strap is present on the medial aspect of a shoe.

OBJECTS AND ADVANTAGES OF THE PRESENT INVENTION

There are several unique features and advantages which may be included in embodiments of the present invention including:

a. an active and changing support to the medial longitudinal arch when the shoe flexes at the forefoot. This occurs naturally during the late portion of the stance phase of the gait cycle as the toes bend.

b. it provides less support to the foot at the early portion of the gait cycle, when the foot needs to be a mobile adapter.

c. a support strap for a shoe which is cosmetic in design.

d. a support strap for a shoe which runs on a diagonal plane, more horizontal than vertical.

e. a shoe having a fulcrum at the forefoot to allow the strap an ability to tighten upon flexing the forefoot.

f. a support strap for a shoe with adjustable tension available in certain styles or designs.

g. a shoe having a stable heel counter and a support strap so the strap does not tilt the counter medially.

Further objects or advantages include a user friendly strap which will be easy to adjust or apply. The strap should be able to function in all types of shoes from dress shoes to athletic shoes, lending support to shoes which otherwise may not have support provided.

SUMMARY OF THE INVENTION

The present invention is a shoe comprising a resilient member therein which member is attached to portions of the shoe so as to create a windlass effect to help support the medial arch of a wearer of the shoe.

In a preferred embodiment, the resilient strap extends from under the forefoot, e.g. at or anterior to the ball of the foot, to a region of the shoe posterior to the medial arch, e.g. the counter.

BRIEF DESCRIPTION OF THE DRAWINGS

FIGS. 3-C and 3-D shows varying placements of the strap between the insole, sockliner, and upper material.

FIGS. 5A–5D shows the various types of adjustable attachments of a windlass strap to the heel counter including 2 styles of hook and pile, and 1 style of buckle.

FIGS. 6A–6D show various types of non-adjustable attachments of a windlass strap to the heel counter including glued and stitched.

Figure 1:
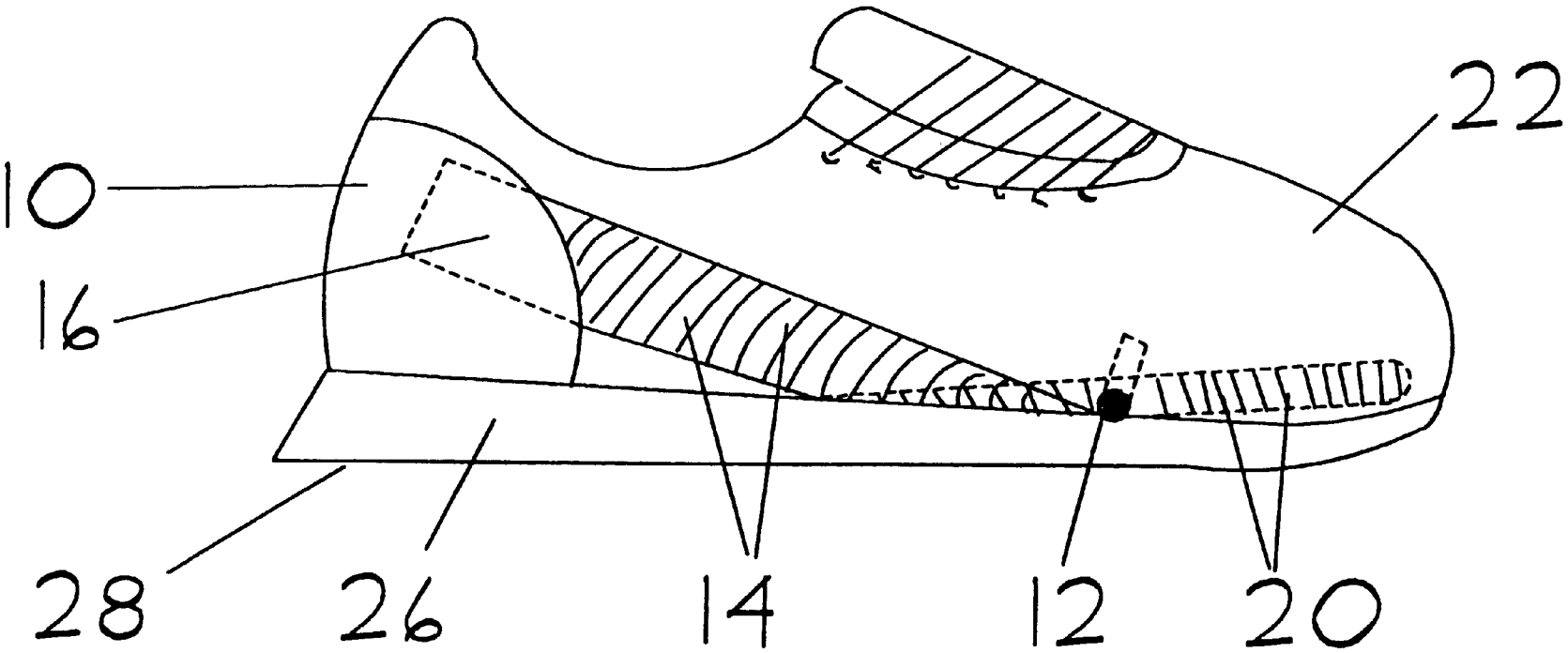
FIG. 1 shows a general overview of the windlass strap on a typical running or athletic shoe. The diagram shows a placement of the windlass strap, a placement of the fulcrum, and the firm heel counter.

| REFERENCE NUMERALS IN DRAWINGS | |
|---|---|
| 10 Heel counter | 12 Fulcrum |
| 14 Windlass Strap | 16 Posterior attachment |
| 18 Sockliner | 20 Anterior aftachment |
| 22 Upper Material | 24 Insole |
| 26 Midsole | 28 Outsole |
| 30 Metatarsal Heads | |

DETAILED DESCRIPTION

This invention relates to a shoe having a strap 14 which originates anteriorly under the forefoot, runs medially along the upper 22 at the longitudinal arch, and inserts near or preferably into the heel counter posteriorly.

Referring to FIG. 1, the windlass strap (14) is shown on an athletic shoe, however the principle will work on any shoe design. The design of the windlass shoe is particularly unique in the midsole (26) and quarter (32) regions of the shoe. The preferred design employs a stable heel counter (10). The most unique part of the shoe design is the windlass strap (14) which starts at the forefoot at or anterior to the ball of the foot and preferably under the toes, then runs diagonally along the medial aspect of the arch and inserts posteriorly to the arch, preferably at the heel counter (10).

Materials

Figure 7:
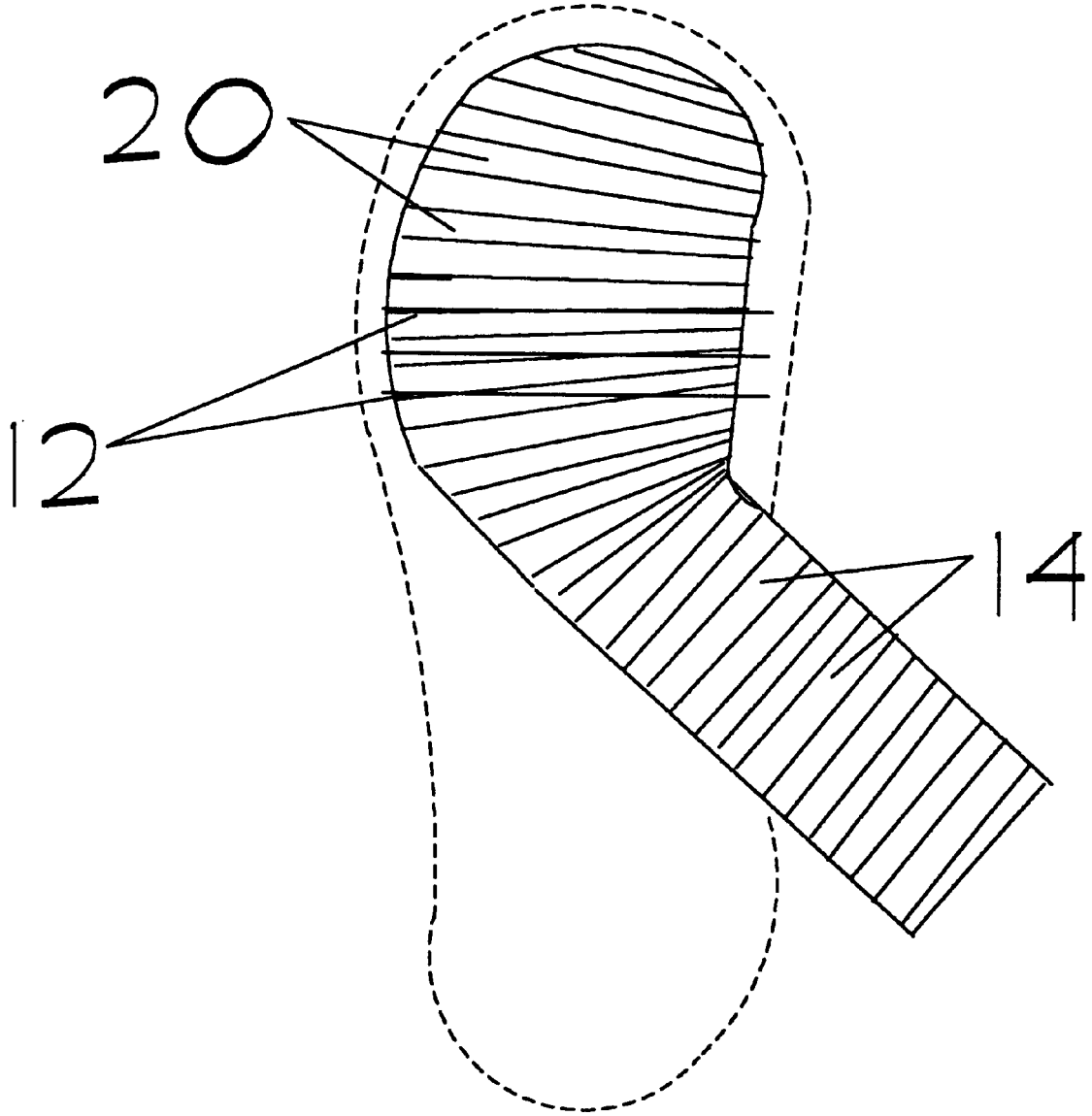
FIG. 7 shows the shape of the material used to form the windlass strap.

The material used to construct the windlass strap (14) should allow pliability yet be relatively longitudinally inelastic. There are many different materials which will work including tightly woven fabrics with various types of weave and materials such as cotton, leather, or synthetic fibers including vinyls, urethanes and poromerics (not limited to these fabrics, however). The shape of the preferred strap material is shown in FIG. 7. The widths of the materials may vary depending on size of the foot and shape of the shoe. The average width of the strap as it runs along the medial longitudinal arch typically may vary from one to four inches but is not so limited. The width under the forefoot will vary with the width of the foot.

Figure 2A:
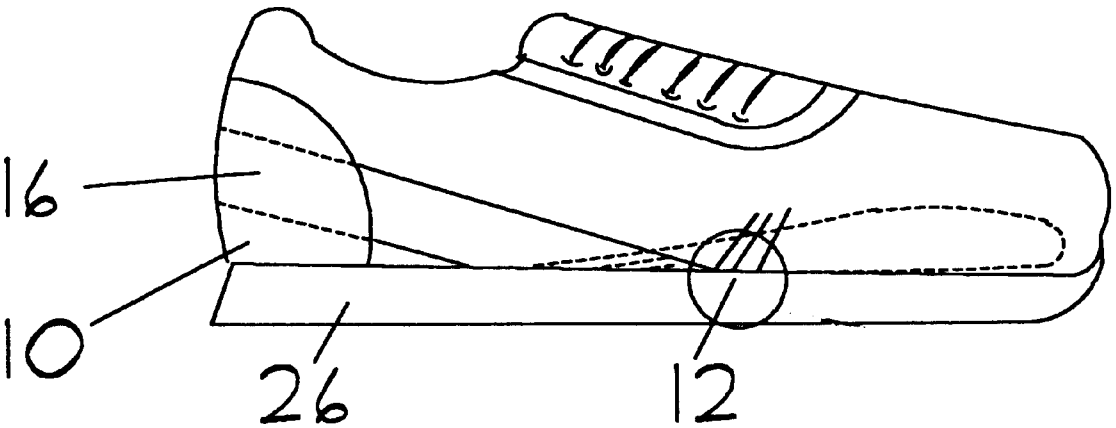
FIGS. 2A–2B, 2C and 2D show the placement of the fulcrum and different styles or variations of fulcrums.
Figure 2C:
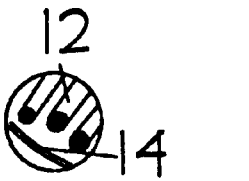
Figure 2D:
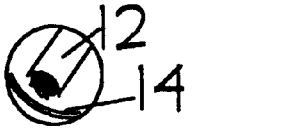
Figure 2B:
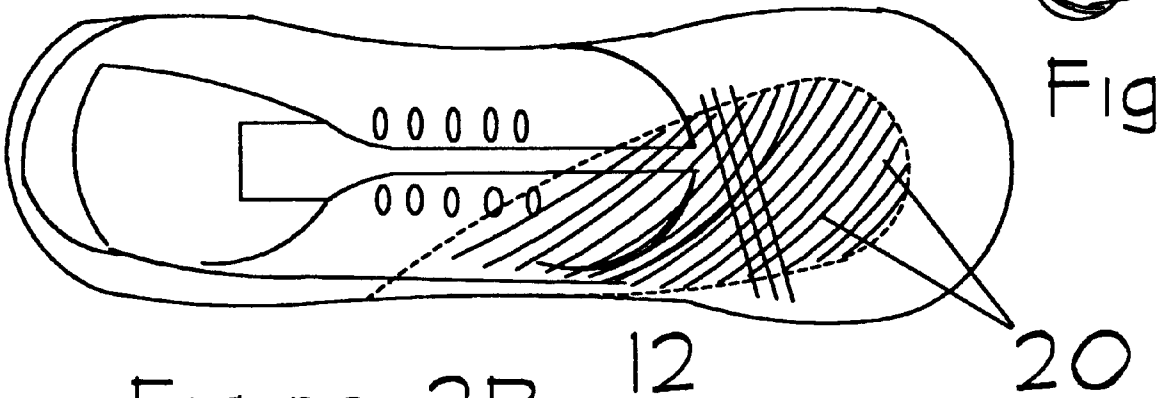

There are three preferred pathways the windlass strap (14) can run along the shoe. One way involves using a man made fulcrum (12) in the midsole (26) of the shoe with the windlass strap (14) running underneath the fulcrum (12). Two ways involve using the metatarsal heads of the foot as a fulcrum and the windlass strap (14) running either inside the shoe between the insole (24) and the sockliner (18) or between the upper material (22) and the midsole (26). A fulcrum (12) is preferably provided in the midsole (26) of the shoe. This material forming the fulcrum (12) preferably has a higher shore value (denser) and should be firmer than the material which normally comprises the rest of the midsole. This fulcrum should be dense enough to resist compression as the windlass strap tightens, yet be soft enough to allow for normal shoe bend at the forefoot. The shape should preferably be rounded and smooth on the end which contacts the windlass strap to avoid excessive wear. Also, a fulcrum can be made as one unit (FIG. 2A), or a series of 2–3 units (FIG. 2B).

Heel Counter

Figure 5A:
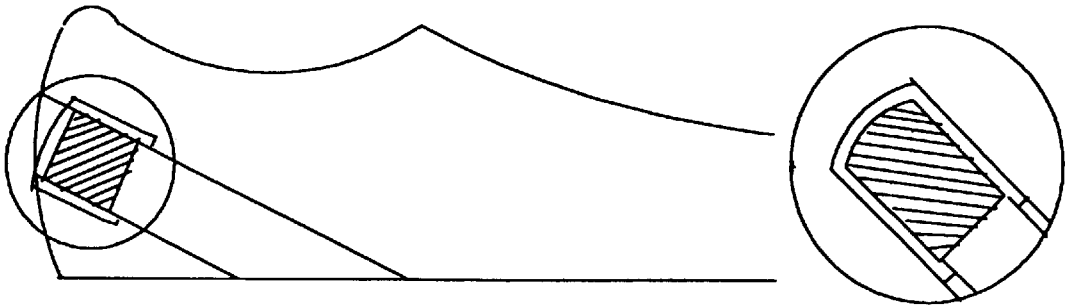
Figure 5B:
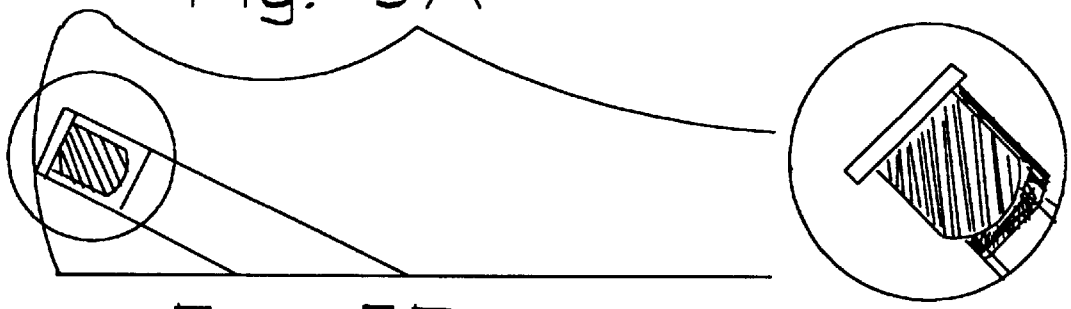

The heel counter (10) is preferably rigid in construction and not allow medial forces from the windlass strap (14) to lean or pull it medially. It may be constructed of a plastic or synthetic fabric which resists torque, lateral lean, or displacement. The attachment of the windlass strap (14) to the heel counter (10) can be on the outside (FIGS. 5A–5C) of the heel counter (10), between the heel counter and the outsole material (FIGS. 6A–6B), or on the inside of the heel counter (FIGS. 3A and 3B).

Location

Figure 3C:
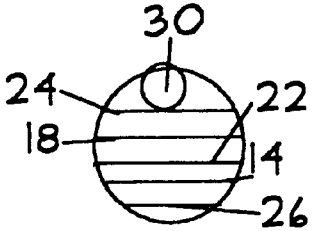
FIGS. 3A, 3B, 3C and 3D show both a side view and top view of the windlass strap in a shoe without a fulcrum.
Figure 3D:
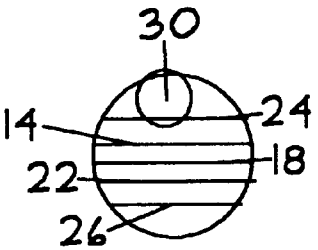
Figure 3A:
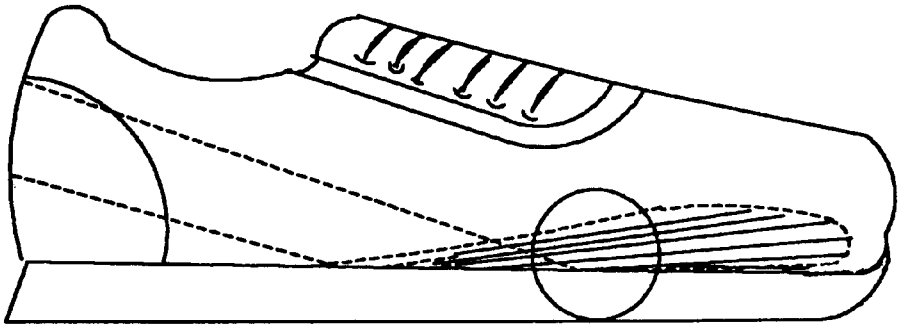
Figure 3B:
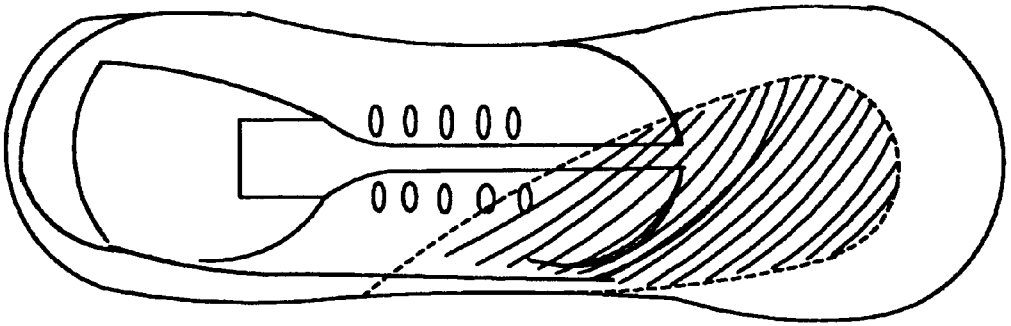

A windlass strap may run under the forefoot so that a fulcrum is formed under the metatarsal heads (30) of the foot (see FIGS. 3A, 3B). A preferred windlass strap (14) can have three locations where a fulcrum can be formed, in the midsole (26)(FIGS. 2C, 2D), between the midsole (26) and upper (22) (FIG. 3C), or inside the shoe between the sock liner (18) and insole (24) (FIG. 3D). If placed in the midsole (26) of a shoe, a hard or solid strip or roll or series of rolls (FIGS. 2C, 2D) may be added under the metatarsal head (30) as an added fulcrum (12) increasing the mechanical advantage for the windlass strap (14) to tighten upon flexing the forefoot. The windlass strap (14) will be loose when the toes are straight, but when the toes bend into dorsiflexion, the windlass strap (14) will tighten, pulling up on the medial longitudinal arch. Another placement of the fulcrum (12) on the outside of the shoe is under the toes between the midsole (26) and the sock liner (18). A windlass strap (14) would preferably run medially along the medial longitudinal arch, and insert into the posterior aspect (16) of the heel counter (10). A windlass strap (14) may also be placed inside the shoe between the foot and the sock liner (18), with an anterior attachment (20) at the forefoot under the toes, running along the medial longitudinal arch and inserting posteriorly (16) on the inside of the heel counter (10). Whether a windlass strap (14) is placed inside or outside the shoe, there should be allowance or movement along the middle one third to one half portion of the strap (FIG. 1) so the windlass strap (14) can tighten along the medial longitudinal arch aspect of the shoe upon dorsiflexion of the foot.

Attachments

Figure 5C:
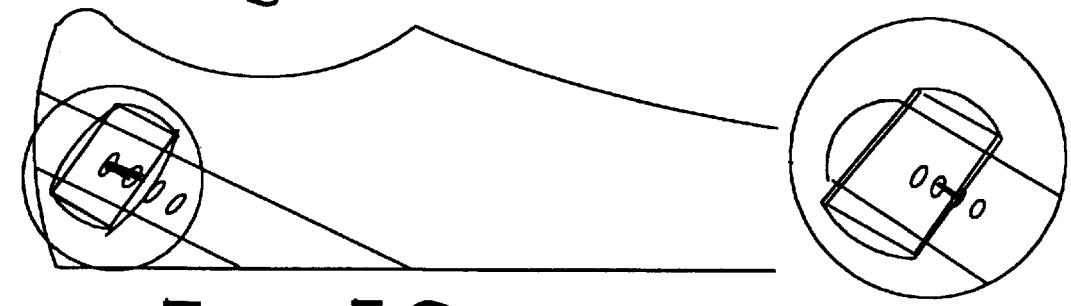
Figure 6A:
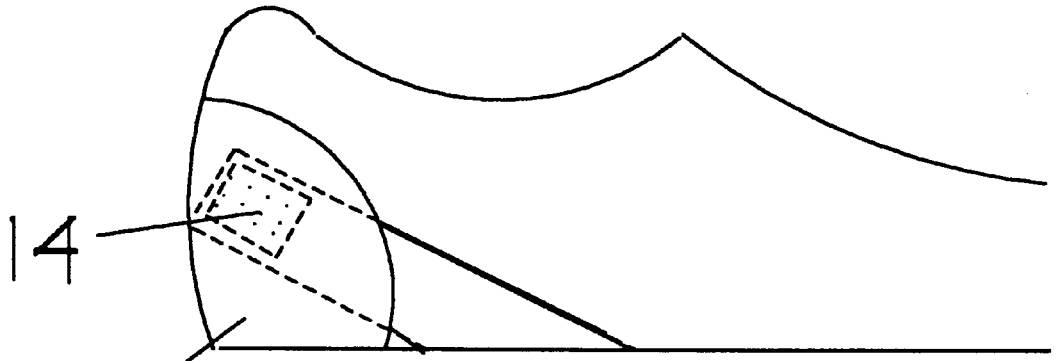
Figure 6B:
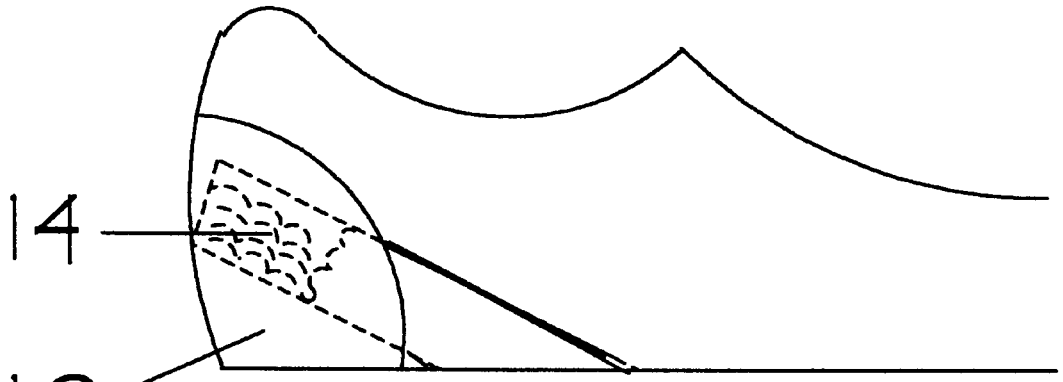

The windlass strap should preferably be anchored at its origin anteriorly (20) under the forefoot by adhesive glue and/or stitching. A windlass straps insertion posteriorly (16) at the heel counter (10) (FIG. 1) can either be non-adjustable (FIGS. 6A–6B) or adjustable (FIGS. 5A–5C) by differents methods. Adjustable methods may include but are not limited to a hook and loop fastener (FIG. 5A), a hook and loop fastener with a plastic ring (FIG. 5B), or buckled (FIG. 5C). These adjustable attachments are preferably anchored to a firm heel counter (10) which resists leaning medially. Non-adjustable methods include glueing the windlass strap (14) to the heel counter (10) and hindquarter portion of the upper (22)(FIG. 6A) or stitching or stapling the windlass strap (14) to the heel counter (10) (FIG. 6B) or a combination. The above methods are merely exemplary and are not meant to be limiting.

OPERATION

A "windlass" shoe is based on the same biomechanical principles as the human foot. The term "windlass" is a winding device like a winch which helps create a mechanical advantage for lifting. This strap is meant to mimic the plantar fascia of the human foot. The plantar fascia in the foot acts like a winch or windlass. As the foot goes from mid to late stance, the plantar fascia tightens as the first through fifth phalanges dorsiflex or bend backward. As the toes bend, this creates a tightening or tension along the plantar fascia and raises the medial longitudinal arch. The tightening of the plantar fascia and raising of the medial longitudinal arch may also help cessation of pronation and initiation of supination of the foot. This allows the foot to become a rigid lever for push off in the late phase of the gait cycle.

The windlass strap runs under the ball of the foot, up along the medial arch on a diagonal plane, and inserts at the heel counter. As the forefoot of the shoe dorsiflexes or bends upward, the windlass strap begins to tighten longitudinally around the fulcrum located at the forefoot, under the metatarsal heads. This longitudinal tightening causes a raising of the medial longitudinal arch. The more the forefoot of the shoe bends, the tighter the windlass strap becomes, pulling harder and harder up on the medial longitudinal arch.

The strap can be designed at one set tension, or as an adjustable tension. The strap is preferably permanently affixed under the plantar surface of the foot on top of the midsole, under the insole. However, the insertion posteriorly at the heel counter can have varied attachments, either fixed or adjustable, including glued, stitched, using a hoop and loop fastener, hooked or buckled. If glued or stitched, the strap would not be adjustable. If fastened with a hook and loop fastener, hooked or buckled, the straps tension could be adjusted, therefore giving more or less support to the medial longitudinal arch.

The strap material construction should allow for bend or twisting to occur, but not allow for elongation longitudinally. This is important in the non-adjustable strap shoe design because if the strap lengthens, it will no longer be effective. Materials can include but are not limited to tightly woven fabric with various types of weave including cotton, leather, synthetic fibers (including nylon, gore-tex, vinyl etc . . . ) and others that are normally used in shoe fabrication.

The adjustable strap can be attached to the heel counter by a variety of means including a hook and loop fastener, lacing, buckle, or hooks. The method used should not loosen during wear since the windlass effect is reliant on stable attachments at both ends.

In the preferred embodiment, a fulcrum should be present to promote the windlass effect. The windlass strap should have something to tighten around as the forefoot bends, much like a winch or "windlass". Therefore, the fulcrum preferably has minimal forgiveness or compression as the strap tightens. If the strap is placed inside the shoe on top of the sockliner, the metatarsal heads will serve as a naturally occurring fulcrum. If the windlass strap is placed under the sockliner in the midsole (as in an athletic shoe), a fulcrum made of a dense material is desireable. It is preferably made of a material with minimal compression, yet still comfortable under the ball of the foot. It preferably runs closely under the normal toe break or crease in a shoe, under the metatarsal heads. It can be constructed as one dense unit, or as a series of dense units, depending on comfort level desired. The fulcrum should be rounded so as not to wear the strap thin, and the windlass strap should run under the fulcrum. It should be noted that the fulcrum can also be the point at which the front end of the strap is anchored to the shoe, such as where the strap extends from and is anchored to the region of the shoe where the ball of the foot would be and the extends posteriorly toward the heal counter.

The heel counter should preferably be sturdy so as to resist leaning medially as the strap pulls on it. The heel counter preferably sits on a firm and stable midsole which should also be constructed of a stable material.

No current shoe on the market is constructed with a windlass strap allowing for active support for the foot. All shoes are passive, meaning there is no movement or changes inside or outside the shoe that supports the foot during the gait cycle. This invention proposes to create a shoe which is ever changing during the normal gait cycle. There are five normal functions of the foot. These functions include:

1) Mobile adaptor at heel strike
2) Absorbs rotation
3) Provides base of support
4) Shock absorber
5) Rigid lever for push-off Basic shoe designs have affected some of the above foot functions but currently are unable to address all of them effectively. Shoes that provide a rigid lever for push-off usually affect shock absorption or mobile adaptation at heel strike since the shoe needs to be firm. The "windlass" shoe allows for ALL FIVE NORMAL FOOT FUNCTIONS IN ONE SHOE, with emphasis on influencing the arch to becoming a rigid lever for push-off. It is therefore an "active" shoe which changes from early stance to late stance in the gait cycle.

PHASES OF GAIT

FIGS. 4A–4D comprise a series of illustrations which correlate with the following 4 stance phases of gait showing how the windlass strap tightens along the medial longitudinal arch, thereby increasing support to the arch.

Figure 4B:
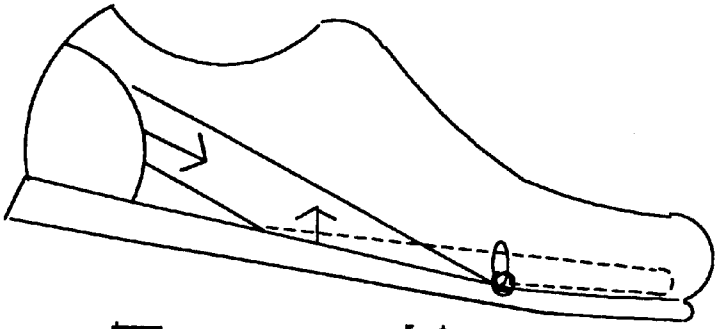
FIGS. 4A, 4B, 4C and 4D show how the windlass strap functions during the various stages of normal walking or running gait. The diagram shows how the windlass strap tightens as the forefoot is flexed into dorsiflexion.
Figure 4D:
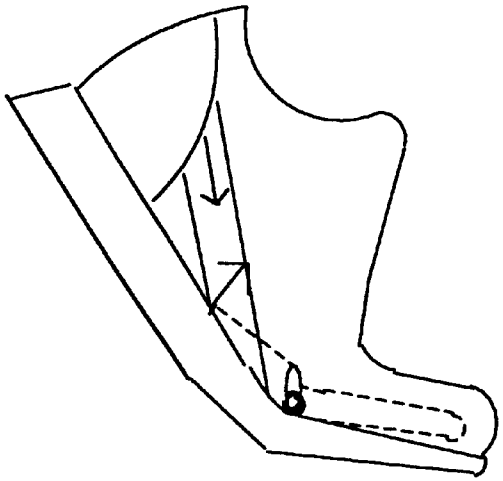
Figure 4A:
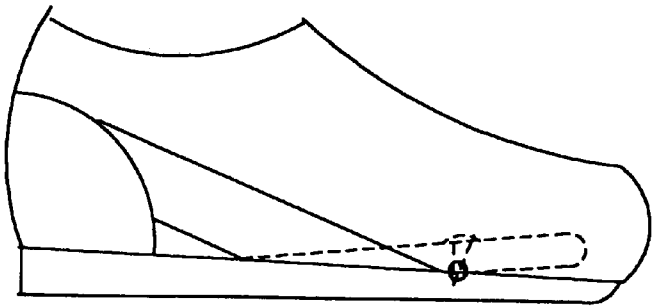

Early Stance: (FIG. 4A)

The shoe will provide normal support to the foot and the windlass strap will be in a relaxed position.

Mid Stance: (FIG. 4B)

The forces under the foot begin to shift anteriorly as we begin to load our metatarsal heads and forefoot. This causes the toes to bend (dorsiflex) and the windlass strap begins to tighten along the medial longitudinal arch.

Figure 4C:
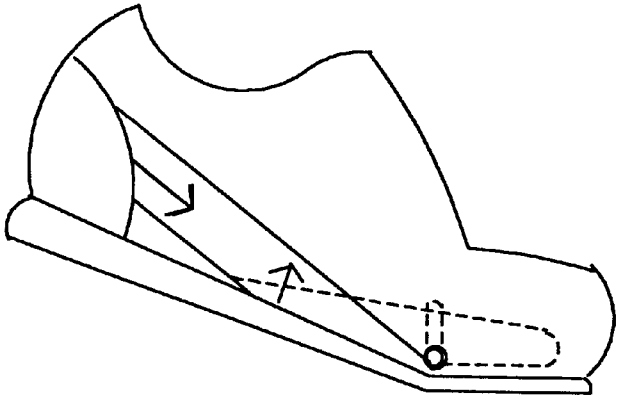

Late Stance: (FIG. 4C)

The forces under the foot continue shifting anteriorly. The toes bend into more dorsiflexion causing more tightening of the windlass strap. As this strap tightens, it actually raises the medial longitudinal arch.

Toe-off: (FIG. 4D)

The toes are now in full dorsiflexion and the windlass is maximally taught. This causes maximal raising of the medial longitudinal arch. The foot is now in a supinated position and a "rigid lever for push-off".

What is claimed is:

1. A shoe comprising a flexible sole, an upper portion of a material different in character from that of the sole, said upper portion connected to said sole, and means attached to said sole for creating a windlass effect to aid in the support of the arch of the wearer of the shoe during the wearer's normal gait, wherein said means comprises a flexible member extending from and affixed to a front portion of the shoe anterior to the ball of the wearer's foot, thence within the shoe across the wearers arch, to a rear portion of the shoe posterior to the wearer's arch to which rear portion it is also attached, said flexible member being comprised of a material which is non-stretchable in the longitudinal direction.

2. The shoe of claim 1 wherein the flexible member comprises a strap which is anchored to the shoe at each end of said flexible member.

3. The shoe of claim 2 wherein said sole comprises an anterior region extending forward from the ball of the foot of the wearer, a medial arch region adjacent and posterior to the anterior region, and a heal region posterior to the arch region, and wherein the strap is anchored at the anterior region of the sole forward of the ball of the foot, and also at a position selected from the group consisting of the heal region of the sole and the upper portion adjacent said heal region.

4. The shoe of claim 3 wherein the upper portion of the shoe comprises a rigid heal counter and said strap is anchored to said heal counter.

5. The shoe recited in claim 4 wherein said strap is anchored to said heal counter by adjustable anchoring means.

6. The shoe recited in claim 4 wherein said strap is anchored to said heal counter by non-adjustable anchoring means.

7. The shoe of claim 4 wherein the strap extends from an area of the anterior region of the lower portion of the shoe adjacent the toes of the wearer on a diagonal course therefrom, posteriorly along the medial arch region and to the heal counter in the upper portion of the shoe so as to provide varying degrees of support to the medial arch of the foot of the wearer during the normal gait cycle.

8. The shoe of claim 7 wherein the strap is external to the shoe.

9. The shoe of claim 3 wherein the lower portion comprises a sockliner and an insole thereabove and wherein the strap runs therebetween.

10. The shoe of claim 3 further comprising a fulcrum at the lower portion thereof said fulcrum being located substantially at the area where the wearer'ball of the foot would overlie.

11. The shoe of claim 10 wherein the fulcrum is variable in location in that it is formed due to pressure exerted by the ball of the foot of the wearer on the strap during the mid-stance, late-stance and toe-off phases of the wearers gait.

12. A shoe having a flexible sole, and an upper portion distinguishable from and attached to said sole, said shoe having means for providing an active and changing level of support to the medial arch of the wearer during the normal gait cycle, said means comprising a flexible, non-stretchable, resilient support member having two ends, one end attached to said flexible sole anterior to the ball of the wearers foot and the other end attached to the shoe posterior of the wearers arch, said support member running diagonally across the wearers arch.

* * * * *